US006135463A

United States Patent [19]

Wrike

[11] Patent Number: 6,135,463

[45] **Date of Patent: *Oct. 24, 2000**

[54] IN-LINE SKATE WITH QUICK RELEASE SIDEWALLS AND RELATED ASSEMBLY METHODS

[75] Inventor: Michael C. Wrike, Jamestown, N.C.

[73] Assignee: Rike Industries, Inc., Jamestown, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,169

[22] Filed: Jan. 9, 1997

[51] Int. Cl.[7] ..... A63C 17/06

[52] U.S. Cl. ..... 280/11.22; 280/7.13; 280/11.27

[58] Field of Search ..... 280/7.13, 7.12, 280/7.14, 11.27, 11.26, 11.22

[56] References Cited

U.S. PATENT DOCUMENTS

| | | | |
|---|---|---|---|
| D. 354,539 | 1/1995 | Meibock et al. | D21/226 |
| 3,880,441 | 4/1975 | Silver | 280/11.22 |
| 3,900,203 | 8/1975 | Kukulowicz | 280/11.2 |
| 4,008,901 | 2/1977 | Conn | 280/7.13 |
| 4,418,929 | 12/1983 | Gray | 280/11.23 |
| 4,657,265 | 4/1987 | Ruth | 280/7.13 |
| 4,659,095 | 4/1987 | Halvorsen | 280/11.27 |
| 4,666,169 | 5/1987 | Hamill et al. | 280/11.23 |
| 4,932,675 | 6/1990 | Olson et al. | 280/7.13 |
| 5,046,746 | 9/1991 | Gierveld | 280/11.22 |
| 5,092,614 | 3/1992 | Malewicz | 280/11.22 |
| 5,129,663 | 7/1992 | Soo | 280/7.14 |
| 5,184,834 | 2/1993 | Yu | 280/7.13 |
| 5,193,827 | 3/1993 | Olson | 280/7.13 |
| 5,199,726 | 4/1993 | Willett | 280/11.27 |
| 5,251,920 | 10/1993 | McHale | 280/11.19 |
| 5,253,884 | 10/1993 | Landers | 280/11.27 |
| 5,271,633 | 12/1993 | Hill, Jr. | 280/11.22 |
| 5,277,437 | 1/1994 | Moats | 280/11.23 |
| 5,314,199 | 5/1994 | Olson et al. | 280/7.13 |
| 5,331,752 | 7/1994 | Johnson et al. | 36/115 |
| 5,503,413 | 4/1996 | Belogour | 280/11.22 |
| 5,524,912 | 6/1996 | Laub et al. | 280/7.13 |
| 5,533,740 | 7/1996 | Lin | 280/11.22 |
| 5,549,310 | 8/1996 | Meibock et al. | 280/11.22 |
| 5,829,758 | 11/1998 | Bott | 280/11.22 X |
| 5,873,584 | 2/1999 | Wrike | 280/11.22 |

FOREIGN PATENT DOCUMENTS

| | | | |
|---|---|---|---|
| 8701-675 | 2/1989 | Netherlands | 280/7.13 |
| WO 93/07938 | 4/1993 | WIPO | 280/7.13 |

OTHER PUBLICATIONS p. 50 Popular Mechanics, Nov. 1991.

*Primary Examiner*—J. J. Swann
*Assistant Examiner*—Michael Mar
*Attorney, Agent, or Firm*—Myers Bigel Sibley & Sajovec

[57] ABSTRACT

An in-line roller skate frame includes quick release sidewalls, associated frame, and related methods. The sidewalls are configured to be easily individually inserted and removed without negatively impacting the frame profile. As such, the quick release sidewalls allow for skaters to loosen a fastener, retract a fastening bracket, and slideably detach the selected sidewall(s).

9 Claims, 3 Drawing Sheets

IN-LINE SKATE WITH QUICK RELEASE SIDEWALLS AND RELATED ASSEMBLY METHODS

FIELD OF THE INVENTION

The present invention relates to skates, and more particularly, to frames for in-line roller skates and ice skates.

BACKGROUND OF THE INVENTION

In-line skating continues to grow in popularity for use in a variety of recreational and sporting activities. This popularity corresponds to increasingly sophisticated consumers who are constantly seeking and demanding increased performance capabilities for their skates under a variety of extreme conditions. Ramp skaters demand durable, strong, and lightweight skates which will respond to the slightest physical directional movement on ramp surfaces that drop off in dramatic angles of descent and inclination. Outdoor and indoor hockey players alike prefer tough, durable, lightweight, and performance yielding skates which respond to the playing style and demands of an aggressive and rough sport. Further, skaters want skates that have custom performance capabilities on multiple surfaces and in multiple sporting arenas.

Unfortunately, the best performing outdoor surface skates may not be the same skates that give the best results on indoor surfaces. For example, some skaters in some activities prefer a low skate frame profile (the skate platform's vertical distance from the floor) and a specific number of wheels. The skate profile plays an important role in both the aesthetic appearance of the skate and important performance characteristics attributed to the profile. For example, a higher profile will yield a higher center of gravity ("$C_g$") than a lower frame profile. Generally, performance-driven skaters prefer lower skate profiles because this type of design provides more control and improved handling than higher skate profiles.

Thus, in one situation, a skater may prefer a skate with a low profile and a lesser number of wheels such as three wheels, while in another sport prefer a skate with six wheels—or even ice blades instead of wheels—depending on the activity and the playing environment. These different requirements can force players either to purchase multiple pairs of skates or play with skates which have some interchangeability feature but which typically compromise their performance on one or more of the playing surfaces.

Most in-line skates include a boot attached to a frame assembly which supports the axles and wheels of the roller skate. Therefore, in order to change the configuration of the skate, the skater must somehow change-out or replace the frame or certain components thereof which contain the support for the axles and wheels in order to produce the desired configuration. These changeable components should be able to be securely attached and reattached in a repeated use environment. However, because many players change-out their skates on the sidelines during competitions, and repeat these changeouts over and over, many attachment devices, such as threaded members, wear prematurely. In addition, because many of these players carry their skates and replacement components into the locker rooms and game to game, it is desirable to minimize the tools and the number and size of pieces which must be employed to yield an "interchangeable" skate and associated replacement parts.

Although several skates propose an interchangeability feature, many do so in an unwieldy and performance impacting manner. Further, many of the combination skates merely configure the boot istself to releasably engage into different relatively large, separate, and even complex frame assemblies.

Examples of "interchangeable" or combination skates include the skate designs proposed in U.S. Pat. No. 5,193,827 to Olson, U.S. Pat. No. 4,932,675 to Olson et al., U.S. Pat. No. 4,666,169 to Hamill et al., U.S. Pat. No. 4,657,265 to Ruth, and U.S. Pat. No. 5,314,199 to Olson et al. However, these designs generally include a boot-to-frame interchange feature, disadvantageously requiring a large part of the frame to be changed in order to provide alternative skate configurations. For example, Olson '827 proposes a boot with downwardly extending protrusions (the front one having an interlocking notch) which are received into corresponding recesses in the blade support assembly and which lock together via a rotating cam device. As proposed, the boot can be inserted into a roller or ice skate blade assembly platform. Unfortunately, this interlocking boot configuration can induce an undesirable higher skate profile, and may also necessitate a potentially costly, time consuming, and inefficient frame sub-assembly changeout.

One partial solution is offered in co-pending and co-assigned U.S. Patent Application entitled, "Toe Plate with Dual Flanges for In-Line Skate Frame", (Attorney Docket Number 5565-3), filed concurrently herewith, which discloses an in-line dual flange sidewall skate frame. The disclosure of which is incorporated herein by reference. The dual flange configuration employs side walls which can be interchanged side to side and also which can be singularly replaced in the event of breakage. This design also offers responsive-handling performance characteristics. Unfortunately, the side wall attachment bolts can be exposed to repeated wear and tear by impatient players in sometimes inhospitable environments. Additionally, the sidewall configuration can require additional time to remove and reattach the plurality of transversely inserted threaded components which securely attach the side wall members to the frame and, ultimately, to the boot.

OBJECTS AND SUMMARY OF THE INVENTION

In view of the foregoing, it is a first object of the present invention to provide an improved sidewall attachment and release mechanism which provides both easier fastening and increased custom performance capabilities for skates employed on multiple types of surfaces.

It is an additional object of the present invention to releasably interconnect interchangeable frame sidewalls without sacrificing a performance loss in a desired frame profile.

It is a further object to reduce the thread wear on bolts employed in the sidewall attachment of frame assemblies.

These and other objects are satisfied by the present invention which as a first aspect includes an in-line roller skate with "quick-release" sidewall mounting means. The in-line skate frame assembly is adapted to be attached to the sole of a boot or shoe which has toe and heel portions. The frame assembly comprises a frame platform having toe and heel portions corresponding to the boot toe and heel portions and an upper face and a lower face. The frame platform upper face is attached to the boot sole and the frame platform lower face includes sidewall quick release engagement portions thereon. The frame assembly also includes first and second downwardly extending quick release sidewalls having front and rear upper portions. The quick release sidewalls are releasably engaged with the frame platform quick release engagement portions which are disposed on the frame lower face. The first sidewall is configured such that the rear upper portion is received into a corresponding frame heel portion and the front upper portion is received into a corresponding frame toe portion. The second sidewall is spaced apart from the first sidewall and received into opposing toe and heel portions. The frame assembly further includes a fastening mechanism releasably attached to the sidewalls and the frame for securely attaching the sidewalls and the frame theretogether and for providing a quick release sidewall detachment therefrom.

A second aspect of the present invention is a convertible in-line skate which employs quick-release sidewalls and a frame as described hereinabove. The frame further includes a slide and lock fastening mechanism for releasably attaching the first and second quick release sidewalls to the toe and heel plates. A plurality of wheels are rotatably mounted between the first and second sidewalls.

A third aspect of the present invention includes an in-line skate conversion kit for converting the configuration of a skate from one type to another. The skate to be converted includes a boot (or shoe) and two pair of spaced apart forward flanges attached to and extending downwardly from the boot. Each of the forward flange pairs define a forward cavity therebetween. The skate also includes two pair of spaced apart rear flanges extending downwardly from the boot, each of which defines a rear cavity therebetween. The conversion kit comprises first and second downwardly extending quick release sidewalls having forward and rear upper portions. The forward portion of the sidewalls have an engagement channel positioned therein and the rear portion of the sidewalls have a longitudinal locking protrusion extending therefrom. The first sidewall is configured such that the rear upper portion is receivable into one of the rear cavities and the forward upper portion is receivable into a corresponding one of the forward cavities. The second sidewall is received into opposing ones of the forward and rear cavities. The sidewalls are configured to support a predetermined blade configuration. The kit also includes one of a set of wheels and an ice blade corresponding to a desired blade configuration adapted to be supported by the quick release sidewalls.

A fourth aspect of the present invention is an in-line skate quick release and attach sidewall fastening structure for an in-line skate frame. In a preferred embodiment, the skate frame comprises a dual flange configuration with forward flange cavities which include transversely extending alignment protrusions therein. A corresponding sidewall front upper portion includes a contact surface for contacting and engaging with the forward cavity alignment protrusion. The fastening structure also includes a retractable dual action fastening mechanism having a longitudinally extended position and a longitudinally retracted position cooperating with the front and rear upper sidewall portions and said skate frame. In the extended position, the fastening mechanism urges the sidewalls forward to lock into the frame. Contra, in the retracted position, the fastening mechanism releases the sidewalls from the frame.

Another aspect of the present invention is an in-line skate quick release and attach sidewall fastening method for mounting a sidewall of a frame carrying the blades of an in-line skate. The mounting method comprises the steps of sliding a first quick release sidewall into one of the forward and rear flanges so that the sidewall engagement surface engages with a corresponding receiving surface disposed in at least one of the corresponding flanges. A fastening member is advanced in the longitudinal direction to an extended position to contact an upper portion of the first sidewall. Advantageously, the first sidewall is quickly and easily secured to corresponding ones of the flange pairs in a slidably releasable manner.

An additional aspect of the present invention is a quick release in-line skate sidewall for supporting in-line blades. The quick release sidewall comprises a substantially planar downwardly extending body sized to be thin in width and to longitudinally extend substantially the length of a boot. The sidewall has forward and rear upper portions and corresponding bottom portions and the bottom portion includes a plurality of spaced-apart apertures formed in a predetermined pattern therein. The upper portion includes an alignment channel formed therethrough and adapted to be assembled to an in-line skate frame.

The quick release configuration of the sidewalls and the mating configuration of the associated frame components allow for quick release and attach sidewall mounting. Advantageously, the sidewalls are individually slidably insertable to be assembled with mating frame components and reduce the number of frame to sidewall attaching screws or components and thereby allow for faster and easier assembly thereto.

The foregoing and other objects and aspects of the present invention are explained in detail in the specification set forth below.

DETAILED DESCRIPTION OF THE PREFERRED EMBODIMENTS

The present invention will now be described more fully hereinafter with reference to the accompanying drawings, in which preferred embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

The present invention relates to an in-line skate frame, convertible skate kit, quick release sidewalls, and associated method for replacing and mounting an in-line skate frame including components thereof. In the description of the present invention that follows, certain terms are employed to refer to the positional relationship of certain structures relative to other structures. As used herein, the term "longitudinal" and derivatives thereof refer to the general direction defined by the longitudinal axis of the boot or other footwear associated with an in-line skate that extends between the toe and the heel of the boot. As used herein, the terms "outer", "outward", "lateral" and derivatives thereof refer to the direction defined by a vector originating at the longitudinal axis of the boot and extending horizontally and perpendicularly thereto. Conversely, the terms "inner", "inward", and derivatives thereof refer to the direction opposite that of the outward direction. Together the "inward" and "outward" directions comprise the "transverse" direction.

Figure 1:
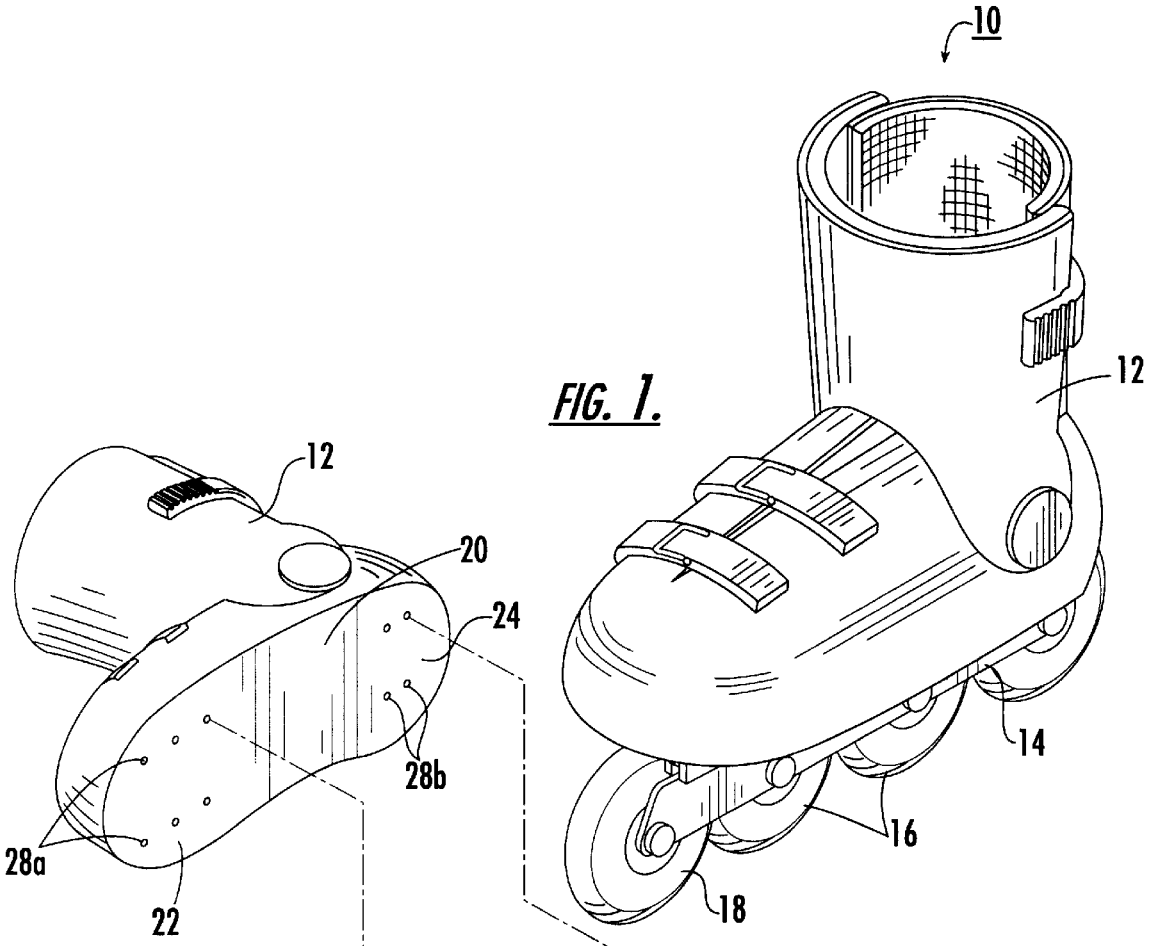
FIG. 1 is a perspective view of an assembled in-line roller skate of the present invention showing the boot, the wheel frame, and the wheels.

Referring now to the drawings, an in-line roller skate according to the present invention, generally designated at 10, is illustrated in FIG. 1. The skate 10 includes a boot 12 (which can also be a shoe or other similar footwear), a frame 14 attached to the underside thereof, and a plurality of wheels 16 that are rotatably and removably mounted on the frame 14 for rotation about their respective axles 18.

The boot 12 includes a sole surface 20 having a toe portion 22 and a heel portion 24 to which the frame 14 is attached. The frame assembly 14 can be configured to include a frame platform 15 which is attached to and extends downwardly from the sole of the boot 20. As such, the frame platform can be either integral to the boot (e.g., molded) or assembled to the boot with conventional fastening techniques including screws, high strength adhesives, and the like. Further, as described herein, the frame assembly 14 includes a frame platform 15 which can be either a single or multi-piece component (as is illustrated herein). If a single piece platform is employed then it is preferred that it be substantially continuous and extend the length of the shoe or boot.

Figure 2:
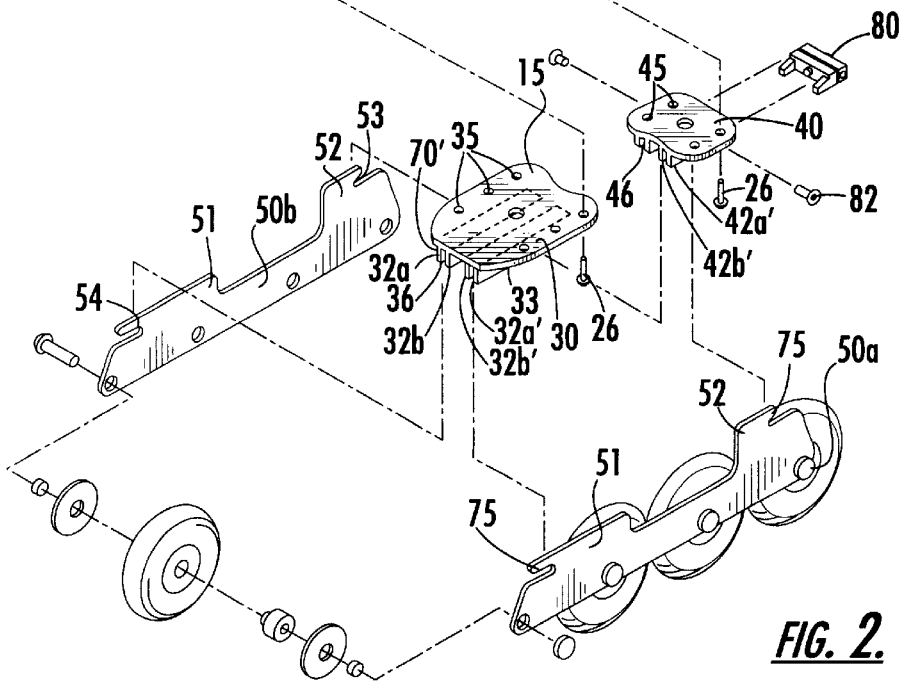
FIG. 2 is an exploded perspective view of the in-line roller skate of FIG. 1 illustrating interconnection of the wheels, frame components, and boot.
Figure 3:
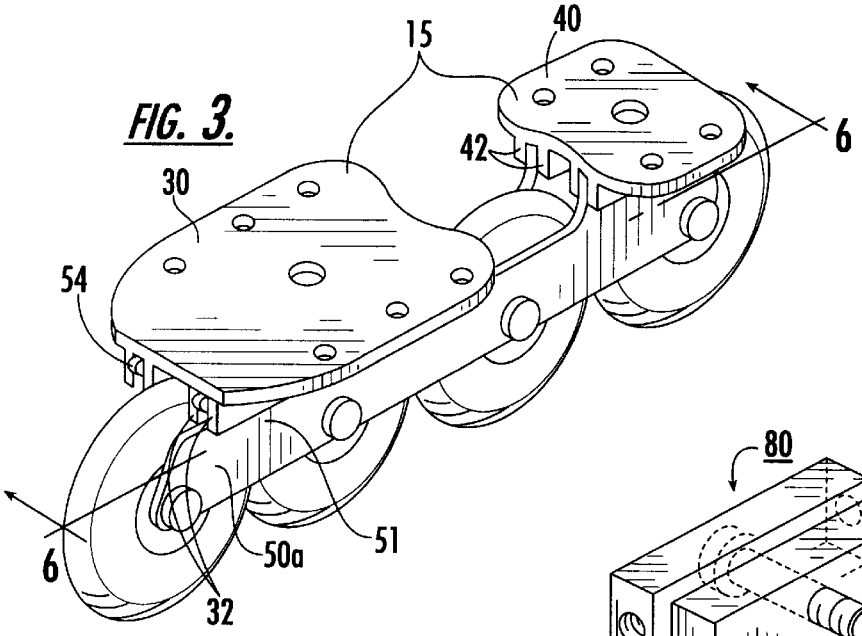
FIG. 3 is a perspective view of the assembled toe and heel plates and the quick release sidewalls of a skate frame of the present invention.
Figure 4:
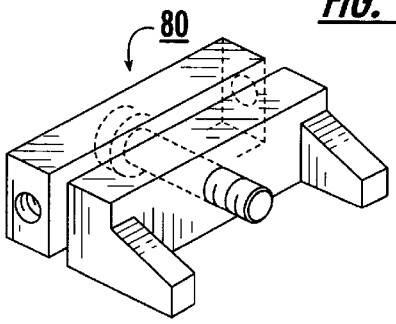
FIG. 4 is a perspective view of an expansion block of the present invention.

As illustrated in FIG. 2, a preferred embodiment of the frame 14 includes a multi-piece frame platform 25 including a toe plate 30 and a heel plate 40. The frame assembly 14 also includes detachable quick release sidewalls 50*a*, 50*b*, and a sidewall and frame fastening mechanism 80.

As illustrated in FIG. 2, in order to assemble the boot 12 and boot associated or frame platform components 15 together, a bolt 26 is inserted through each of a plurality of openings 35 disposed about the horizontal surface of a toe plate 30. These bolts 26 are then inserted into matching threaded openings 28*a* disposed along the toe portion 22 of the sole surface 20. The openings 35, 28*a*, and the bolts 26, although illustrated as being the same size, may also correspondingly vary in diameter without affecting the fastening of the frame to the sole.

The bolts 26 are similarly inserted through each of a plurality of openings 45 disposed about the horizontal surface of the heel plate 40, and are inserted into matching threaded openings 28*b* disposed along the heel portion 24 of the sole surface 20. However, as would be readily understood by those skilled in the art, other alternative fastening means, such as rivets or high strength adhesives, can be used to secure the wheel frame 14 to the sole surface of the boot. As illustrated, the bolts 26 are shown as being insertable upwardly into the sole 20; however, the assembly can also be reversed such that the bolts 26 are inserted downwardly into the toe and heel plates 30, 40.

Once the boot 12 and its associated frame components 15 are assembled, they generally remain attached and in place. The quick release sidewalls 50*a*, 50*b* and the fastening mechanism 80 can be easily and quickly attached and released from the frame assembly 14 (i.e, the frame platform 15), according to the user's requirements, such as to change the configuration of the frame profile or the type of blades which are employed therewith, or to individually replace a broken sidewall 50*a* or 50*b*.

A preferred embodiment of a frame adapted for quick release sidewalls according to the present invention is best illustrated by FIG. 2. As shown, the frame 14 includes a multi-piece platform 15. The platform has a toe and heel plate 30, 40 which generally remain in place on the boot or shoe once assembled. It is also preferred that the toe and heel plate include two pair of spaced apart flanges, designated 32*a*, 32*b* and 32*a*', 32*b*', respectively, which extend downwardly from a lower face 33. Each of the flange pairs 32 defines a cavity 36 therebetween. The frame includes sidewall quick release engagement surfaces or portions 70 (FIGS. 6–11) positioned across the flanges 32*a*, 32*b*, 32*a*', 32*b*'.

As used herein, the term "quick-release" generally means that the sidewall and frame have corresponding mating portions disposed thereon such that a reduced number of fasteners is needed to secure the sidewalls to the frame as compared to conventional skates; i.e., there is no need for a fastener at every point of engagement. For example, a configuration is "quick-release" because the frame and sidewalls are configured such that sliding longitudinal movement of the sidewalls 50*a*, 50*b* in a predetermined direction into a frame platform 15 positions and engages corresponding portions of the frame platform 15 and sidewalls 50*a*, 50*b* together. Preferably, a single fastening device is advanced into the frame and locks the sidewalls and the frame in operative position. Advantageously, the sidewall and associated frame portions are easily and quickly attachable and detachable over conventional frame components which typically necessitate multiple transversely inserted screws or bulky sidewall configurations. The sidewalls are configured to be easily individually inserted and removed without negatively impacting the frame profile. Preferably, the quick release sidewalls allow for skaters to loosen a single fastener, retract a fastening bracket, and slideably detach the selected sidewall(s).

As will be discussed in more detail hereinbelow, the toe plate 30 includes an engagement portion 70 which is preferably a transversely extending engagement surface captured between each of the forward flange pairs 32. More preferably, the frame quick release sidewall engagement portion is configured as a pin 71 (FIG. 6) positioned across the flange cavity 36 and captured by each side of the flange pairs 32*a*, 32*b* and 32*a*', 32*b*', respectively. The pin 71 is sized to support a load generated by vigorous sporting activities and also provides a convenient sidewall 50*a*, 50*b* assembly advancement stop. As described above, it is preferred that a quick release toe frame component 70 include a transversely extending surface such as a pin 71. As such, a sidewall 50*a*, 50*b* is slidably inserted into a toe component 30 and is stopped by and captures the pin 71 to engage with the forward frame 15. However, as will be appreciated by those of skill in the art, the sidewall and frame components can be configured in reverse such that the sidewall slides rearwardly to engage with an engagement surface in a heel frame component.

Similarly, it is preferred that the heel plate 40 also include two pair of spaced apart flanges, designated 42*a*, 42*b*, and 42*a*', 42*b*', respectively, which extend downwardly from its lower face 43 to define a cavity therebetween 46. Further, it is preferred that the heel plate be configured to also provide a quick release sidewall engagement portion 70 as will be discussed in more detail hereinbelow.

Figure 6:
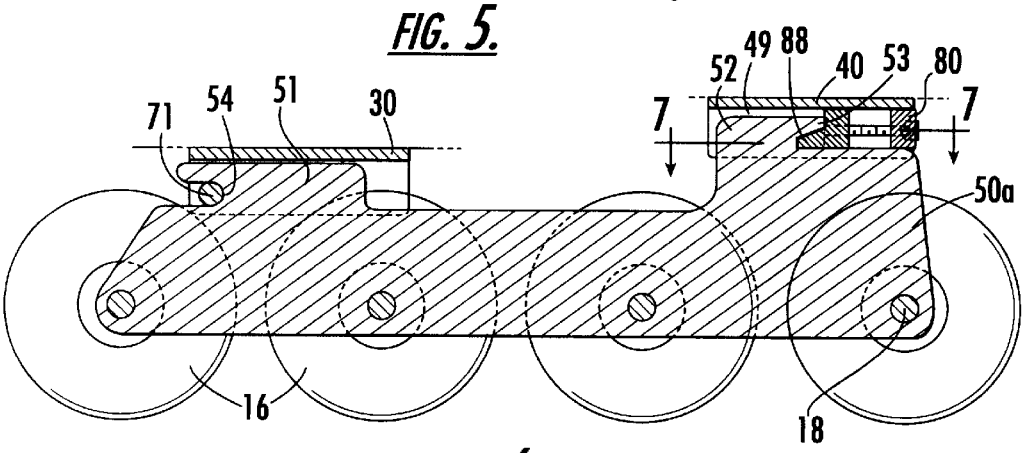
FIG. 6 is an enlarged sectional view of a quick release sidewall taken along lines 6—6 of FIG. 3.

FIGS. 2 and 6 best illustrate one embodiment of the quick release sidewalls 50*a*, 50*b* of the present invention. In this embodiment, the front and rear upper portions 51, 52 of the sidewalls 50*a*, 50*b* are configured to be received into and mate with surfaces disposed within the cavities 36, 46 formed by the flange pairs 32, 42 of the toe or heel plates 30, 40. A longitudinally extending fastening mechanism 80 cooperating with quick release frame engagement portions 70 secures the quick release sidewalls 50*a*, 50*b* once they are positioned in the cavities 36, 46 to the frame 14.

It is preferred that each of the sidewall upper front and rear portions 51, 52 include quick release frame engaging portions 75 corresponding to the frame's sidewall quick release engaging surfaces or portions 70. As best illustrated in FIG. 6, it is also preferred that the sidewall frame engaging portion 75 positioned on the upper front sidewall portion 51 be configured to provide an alignment channel 54 therein. The sidewall channel 54 is sized to receive and capture and thereby to securely engage with a corresponding frame sidewall quick release engaging portion 70 such as a pin 71 as described above.

Figure 11:
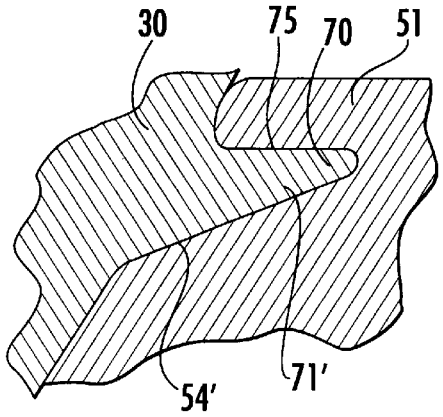
FIG. 11 is a partial cutaway section view of an alternative configuration of the quick release sidewall and associated frame surface engagement portion according to the present invention.

Other quick release frame and sidewall engaging portions 70, 75 can also be employed, including, but not limited to, the embodiment illustrated in FIG. 11. In this embodiment, the frame toe plate sidewall engagement portion 70 is configured as a protruding ramp 71 while the corresponding sidewall frame engagement portion 75 is matably configured to receive the protrusion 54'.

The fastening mechanism 80 is secured to the frame lower face by screws 82 which are transversely inserted into openings 82*a*, 82*b* positioned through each side of a lateral wall of the frame 14. Of course, those of skill in the art will appreciate that alternative attaching techniques, such as welding, brazing, high strength adhesives, or even integral casting or molding with the frame platform 15, would also be appropriate.

Figure 7:
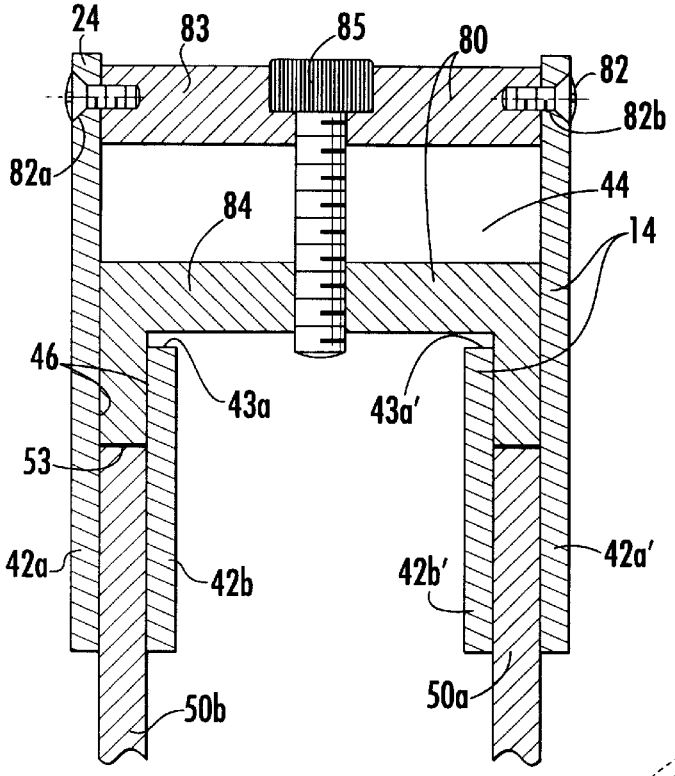
FIG. 7 is a greatly enlarged partial section view of an assembled sidewall and frame taken along lines 7—7 of FIG. 6.

As best illustrated by FIG. 7, in a preferred dual flange embodiment, the downwardly extending heel plate outer flanges 42*a*, 42*a*' extend in the longitudinal direction a greater distance than the corresponding inner flanges 42*b*, 42*b*'. As such, the fastening mechanism can be easily attached to the longer outer flange 42*a*, 42*a*' through apertures 82*a*, 82*b*, respectively, transversely positioned through the lateral wall of the downwardly extending outer flange, and firmly attached, such as with a screw 82.

The corresponding shorter inner flanges 42*b*, 42*b*' allow for a variety of quick release fastening mechanisms because the inner flanges rear surfaces 43*a*, 43*a*' free up a larger frame cavity 44. For example, this cavity 44 allows for a fastening mechanism which is substantially as wide as it is long or which can extend transversely across the area defined between the outer flanges 42*b*, 42*b*' thereby providing a sturdy engaging force to secure the sidewalls to the frame. Advantageously, the shorter flanges will also remove undesirable weight from the skate.

As illustrated, a portion of the fastening mechanism 84 extends forward from the rear of the skate frame 24 to engage with the sidewalls 50*a*, 50*b* and to slide into the cavity 46 defined by the dual flange pairs. It is preferred that the mechanism 80, when in the extended and locked position, firmly contact the upper rear portion of the sidewall 53, the heel inner flanges 42*b*, 42*b*', and the heel outer flanges 42*a*, 42*a*', thereby providing a distributed and static load mounting and engaging surface area.

It is also preferred, as best illustrated in FIG. 7, that the fastening mechanism 80 be configured for insertion between the flange cavities 46 of the frame 14 when a dual flange skate frame is employed. As shown in partial section, the translating member 84 is received into and advances forwardly a predetermined distance into the cavities 46 defined by the heel plate flange pairs 42*a*, 42*b* and 42*a*', 42*b*' respectively. The translating member 84 is sized to be compatible with the flange cavities 46 and to contact and secure the rear portion of the sidewalls 53 to the frame 14. As illustrated by FIGS. 3, 6, 7, and 10, it is preferred that the fastening mechanism frictionally and securely engages with the sidewall(s) and frame to minimize any loose fit or wobble therebetween. As such, lubrication, such as graphite or the like, may be added to the sliding surfaces to assist the assembly thereof. As illustrated by FIGS. 6 and 7, it is also preferred that the rear sidewall upper portion 52 be configured to be contained within the rear flange cavity 46, and it is more preferred that it be configured to extend only a major part of the length of the corresponding inner flange 42*a*, 42*a*'. Advantageously, this configuration allows a fastening mechanism 80 or member to advance into the rear side of the rear flange cavity 46 to trap the sidewall(s) 50*a*, 50*b* securely against the sides (and top) of the cavity and the front of the fastening mechanism 80. The sidewall is prevented from advancing further by the sidewall and frame mating front upper portions 75, 70. This provides a structure which is stable and reduces the stress on the mounting surfaces by distributing the loads introduced thereon.

Figure 5:
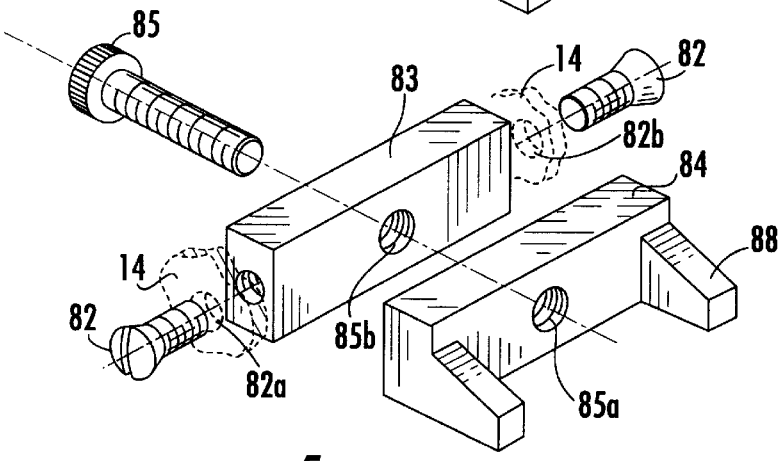
FIG. 5 is an exploded perspective view of the expansion block of FIG. 4, illustrating the sidewall interconnection and the screw advancing mechanism associated therewith.

As best illustrated by the exploded view of FIG. 5, it is preferred that the fastening mechanism 80 be a dual-action fastening mechanism. As used herein, a "dual-action" mechanism is one that can perform two functions, such as it can both urge or bias the sidewall(s) 50*a*, 50*b* into engaging position and secure or fasten the sidewall(s) and the frame 14 together. This is unlike conventional sidewall fasteners which operate only to secure the sidewall to the frame.

The fastening mechanism 80 illustrated is an expansion block which includes a stationary member 83 and an translating member 84 with a centrally aligned hole 85*a*, 85*b* disposed therein. An advancing Allen screw 85 is inserted into each of the openings 85*a*, 85*b* and rotated to advance or retract the translating member 84 in a longitudinal direction. The rotation of the screw 85 advances the translating member 84 and can be directed in either a clockwise or a counterclockwise direction as dictated by the threads positioned on the advancing screw 85 and corresponding threads disposed in the openings 85*a*, 85*b*.

It is preferred that the translating member 84 include a forward portion 88 which is configured to mate with a rear portion 53 of the sidewalls in order to be able to securely engage and lock the sidewalls 50*a*, 50*b* into position when the translating member 84 is in the proper extended position. As illustrated by FIGS. 5 and 6, the forward portion 88 is a ramp or wedge shaped protrusion which is matably received into a inversely ramped or wedge-shaped channel rear portion 53. But, of course, the invention is not limited thereto and one of skill in the art would recognize that these mating surfaces can be provided in any number of acceptable configurations.

Also, as illustrated, it is preferred that the fastening mechanism 80 be integrally provided as a single device to urge both sidewalls 50*a*, 50*b* forward simultaneously and then lock into position to secure the sidewalls to corresponding frame components 30, 40. However, alternatively, the fastening mechanism 80 can be provided as two separate expansion blocks, each securing one sidewall to the frame. In addition, the fastening mechanism can be supplemented with springs such as coil or leaf springs, pistons, cam surfaces or other biasing devices to urge the sidewall into position (not shown).

As will be readily understood by those skilled in the art, other releasable fastening means can be employed to releasably attach quick release sidewalls 50*a*, 50*b* to the frame 14, i.e., the toe plate 30 and heel plate 40. For example, one alternative to the screw-advanced fastening mechanism illustrated herein comprises a block or wedge member associated with a rack and pinion gear unit. Such unit can drive a member attached thereto relative to a predetermined turning ratio of the gear. Preferably, the pinion is outwardly accessible for external advancing and retracting of the fastening mechanism (not shown). Further, it is possible to employ a fastening device which is manually inserted, advanced, and then fixably secured to the frame. For example, a longitudinally inserted holding block or bracket having a stationary wedge surface and an associated transversely mounted frame engaging spring loaded pin for easy installation and disassembly (not shown) can be employed. In such an embodiment one pulls the pin(s) laterally away from the frame to remove the bracket and free the sidewall (s). In reverse, one positions the sidewall(s) on the skate frame components, inserts the holding bracket and aligns the spring loaded pin with an associated bracket opening, and releases to enable the spring loaded pin to lock and load the sidewalls to the frame.

Figure 8:
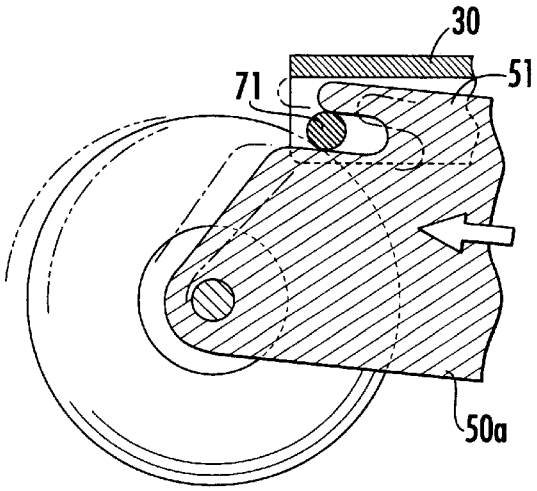
FIG. 8 is an enlarged cutaway partial side view of one embodiment of the present invention illustrating the sliding engagement of a forward upper portion of the quick release sidewall with the frame toe plate.
Figure 9:
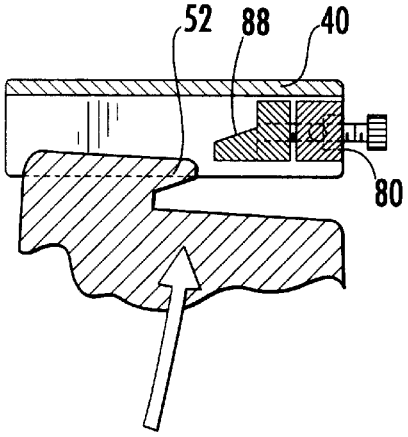
FIG. 9 is an enlarged cutaway partial side view of one embodiment of the present invention illustrating the rear upper portion of the quick release sidewall and its engagement with the frame and expansion block.
Figure 10:
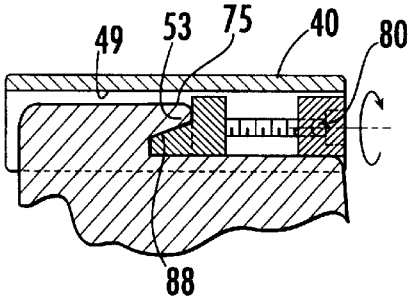
FIG. 10 is an enlarged cutaway partial side view of the embodiment illustrated in FIG. 9 illustrating the longitudinal advancement of the expansion block and its extended positional engagement with the upper portion of the rear sidewall.

In any event, it is preferred that the fastening mechanism 80 be configured to allow exterior access for ease of releasing and reassembling sidewalls while also remaining flush or recessed relative to the profile of the frame and or boot in order to minimize skater contact with any protruding and potentially injury inducing structure during skating activities. As illustrated in FIGS. 8 and 9, in one embodiment, the frame 14 is constructed by sliding the upper front portion 51 of a quick release sidewall 50*a* having a frame engaging surface 75 to mate with the respective frame sidewall engaging portion 70. The rear upper portion of the sidewall 53 is then inserted into a corresponding frame engaging portion 40, and the fastening mechanism 80 is advanced to engage and lock the sidewalls 50*a*, 50*b* and the frame 14 together. In reverse, the fastening mechanism 80 is retracted, the rear portion 52 of at least one of the sidewalls 50*a*, 50*b* is disengaged from the frame, and the front portion 51 of the corresponding sidewall can be quickly and slidably removed from the frame.

As shown in FIG. 5, the upper portions of sidewalls 50*a*, 50*b* are insertable into the cavities 36 of the flange pairs 32*a*, 32*b*, 32*a*', 32*b*' and are sized and configured to contact the inner lateral faces of the flanges 32*a*, 32*b*, 32*a*', 32*b*' when the sidewalls are properly advanced and positioned in the frame components. The sidewalls are preferably advanced and secured by a dual action fastening mechanism 80, such that the fastening mechanism both urges at least one sidewall forward and then firmly engages with the frame and sidewall to lock it into operative position. Similarly, the cavities 36 are likewise sized and configured to receive corresponding sidewall upper portions to provide a snug or abutting fit therewith. This tight fit of corresponding sidewall upper portions and flanges 32*a*, 32*b* advantageously provides a load distributing mounting surface and also provides improved skate performance responsive to skater movements.

Although as described herein the toe plate and heel plate are typically similarly configured to each include dual flanges, it will be appreciated by those of skill in the art that the invention is not limited thereto. For example, the toe plate 30 alone can be configured to comprise dual flanges while the heel plate can be configured to include a single mounting flange (not shown) as well as the reverse.

As will be appreciated by one of skill in the art, the frame quick release sidewall engagement portion 70 can be provided in any number of suitable configurations, such as but not limited to wedge shapes including reversed or inverse shaped wedge portions, pins, or other lateral protrusions which can trap or mate with a sidewall portion which is sized and adapted to engage therewith.

The toe plate 30 and heel plate 40 are preferably constructed out of a relatively lightweight low cost material, such as aluminum. Further, it is desirable that the toe and heel plate 30, 40 be constructed from a material which is easily machined, such as aluminum, in order to simplify their manufacture and further so as to economically allow various shaped engagement portions to be manufactured thereon.

In addition, although it is preferred that the sidewall be configured with a forwardly disposed alignment channel 54 so as to slide into and be captured by a transversely disposed pin 71 in the toe cavity 36 while the rear upper portion 53 engages with the fastening mechanism 80, the invention is not limited thereto. For example, it is also possible to reverse the configuration of the sidewalls and corresponding frame components. Further, it is also preferred that the sidewalls be constructed of a strong, lightweight material such as titanium. Preferably when titanium is employed, a simply configured sidewall design is used, as titanium can be expensive and difficult to machine. Therefore, in order to minimize machining costs, a design which allows for stamped fabrication methods is desired. Thus, a relatively thin sidewall of about 63.5 mm or less is preferred. It is also preferred that the sidewall length be approximately equivalent to a corresponding boot size. Although this length can vary, an exemplary length is about 256 mm.

Further, the frame can also be configured so that is lacks a dual flange or has only a partial dual flange such that the heel plate is different from the toe plate. For example, the frame can be open in the heel such that a fastening mechanism attached thereto can extend both longitudinally and transversely to contact both sidewalls and secure the sidewall side to side against a single mounting frame wall as well secure the sidewall forward. Alternatively, the fastening mechanism can be configured to include a yoke to trap transversely the rear portion of the sidewalls therein as it longitudinally advances as well as to advance the sidewalls into the forward portion of the frame. The yoke is sized to firmly engage the sidewall(s) and to prevent side to side movement of the sidewall. Accordingly, although a dual flange frame has been described as the preferred embodiment quick release frame, because it advantageously allows more exterior impact protection for the downwardly extending sidewalls and can also provide a stronger joining between the sidewalls and frame, it will be appreciated by those of skill in the art that the invention is not limited thereto.

Further, as best illustrated by FIGS. 8 and 11, it is preferred that all edges and transition regions be provided with a radius or fillet to provide stress relief, particularly at load bearing edges of the frame and the intersections of the frame with the sidewalls.

An alternative embodiment of a skate assembly of the present invention is a skate with a boot and an integral body which includes dual flanges 32*a*, 32*b*, 32*a*', 32*b*' without the need for separate toe and heel plates. For example, a molded polymer or carbon reinforced fiber sole/frame body combination can be manufactured so that a boot portion to include the downwardly extending dual frames. In such a situation, the dual flange configuration can, like the separate toe and heel plate flanges described hereinabove, be spaced apart under substantially the corresponding boot heel and toe portions, or can extend further than the heel and toe areas and can even extend continuously along the length of the boot (not shown).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended t6 cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An inline skate frame assembly, adapted to be attached to the sole of a boot having heel and toe portions, comprising:

a frame platform having an upper face and a lower face and toe and heel portions corresponding to said boot toe and heel portions, said frame platform upper face adapted to be attached to said boot sole, wherein said frame lower face includes toe and heel flange pairs, each of said flange pairs including two pairs of spaced apart downwardly extending flanges defining pairs of heel and toe cavities, wherein an engagement projection extends from at least one of said flanges ofeach of said toe flange pairs within said toe cavities;

separate first and second downwardly extending sidewalls having front and rear upper portions received within respective front and rear toe and heel cavities, each of said sidewalls including a front recess that engages one of said engagement projections of said toe flange pairs, each of said sidewalls further including one of a rear engagement recess and a rear engagement projection; and a biasing unit configured to engage one of said rear engagement recess and said rear engagement projection and biasing said first and second sidewalls longitudinally toward said front recess.

2. An in-line skate frame assembly according to claim 1, wherein said biasing unit comprises an expansion block mounted on said frame platform lower face between said sidewalls, said expansion block being moveable between extended and retracted positions, wherein in the extended position said block contacts said sidewalls and urges said sidewalls forward to engage with said frame engagement portion, and wherein in the retracted position said block retracts from said sidewalls thereby allowing said sidewalls to disengage from said frame.

3. An skate frame according to claim 2, wherein said expansion block comprises an outwardly accessible screw for moving said block between the extended and retracted positions.

4. A convertible in-line skate, comprising:

a boot having a sole surface with heel and toe portions;

a frame, comprising:

a toe plate having an upper face and a lower face, said upper face being affixed to said sole surface toe portion, said toe lower face including a quick release engagement portion;

a heel plate having an upper face and a lower face, said upper face being affixed to said sole surface heel portion;

separate first and second downwardly extending quick release sidewalls having front and rear upper portions, said upper portions including a quick release engagement portion thereon, wherein said first sidewalls is configured such that said rear upper portion is received into said heel plate lower face and said front upper portion is received into a corresponding toe plate lower face such that said sidewall front upper portion engages with said toe lower face quick release engagement portion, and wherein said second sidewall is spaced apart from said first sidewall and received into opposing toe and heel plate lower faces such that said second sidewall quick release portion engages with said toe lower face quick release portion;

a longitudinally extendable mechanism attached to said heel plate between said sidewalls and operably associated with said first and second sidewalls for releasably attaching said first and second quick release sidewalls to said frame and biasing said sidewalls in a forward direction; and a plurality of wheels rotatably mounted between said first and second sidewalls.

5. A skate frame according to claim 4, wherein said longitudinally extending mechanism further comprises an expansion block having a locking surface configured with at least one forward leading inclined surface adapted to engage a rear portion of each of said sidewalls.

6. A skate frame according to claim 4, wherein said expansion block comprises an outwardly accessible screw for moving said block between the extended and retracted positions.

7. An in-line skate conversion kit for converting the configuration of a skate from one type to another, said skate including a boot and two pairs of spaced apart forward flanges attached to and extending downwardly from said boot, each of said forward flange pairs defining a forward cavity therebetween, and two pair of spaced apart rear flanges extending downwardly from said boot, each of which defines a rear cavity therebetween, comprising:

first and second downwardly extending quick release sidewalls having forward and rear upper portions, said forward portion having an engagement channel positioned therein and said rear portion having a longitudinal locking protrusion extending therefrom, wherein said first sidewall is configured such that said rear upper portion is receivable into one of said rear cavities and said forward upper portion is receivable into a corresponding one of said forward cavities, and wherein said second sidewall is received into opposing ones of said forward and rear cavities, said sidewalls configured to support a predetermined blade configuration; and one of a set of wheels and an ice blade corresponding to a desired blade configuration adapted to be supported by said sidewalls.

8. An in-line skate conversion kit according to claim 7, wherein said kit comprises at least one set of wheels and an ice blade.

9. An in-line skate quick release and attach sidewall fastening structure for an in-line skate frame comprising a boot and two pair of spaced apart forward flanges and two pair of spaced apart rear flanges, each of said flange pairs defining a cavity therebetween, said forward cavities including transversely extending alignment protrusions therein, comprising:

first and second quick release sidewalls having front and rear upper portions, said front and rear upper portions being adapted to be received into corresponding ones of said forward and rear cavities, and wherein said front upper portion includes a contact surface for contacting and engaging said alignment protrusion; and a retractable dual action fastening mechanism having a longitudinally extended position and a longitudinally retracted position cooperating with said front and rear upper sidewall portions and said skate frame, wherein in the extended position said fastening mechanism urges said sidewalls forward to lock into said frame, and in the retracted position said fastening mechanism releases said sidewalls from said frame.

* * * * *

UNITED STATES PATENT AND TRADEMARK OFFICE

CERTIFICATE OF CORRECTION

PATENT NO. : 6,135,463
DATED : October 24, 2000
INVENTOR(S) : Micheal C. Wrike

It is certified that error appears in the above-identified patent and that said Letters Patent is hereby corrected as shown below:

Column 9, Line 58 and Column 10, Line 32,
Please insert after "advanced to" and before "which is"
--Fig. 9 to better show the certain design features. The fixed idlers are rotatably attached to the top or bottom place 70 or 72, or to both plates, and are shown in other Figures.

Turning to Figs. 9 and 11A, a right conventional chain 80 extends around the top sprocket 110 on the differential 108, around a conventional chain rear active idler 99 and around the right rear drive axle sprocket 57. A fixed idler 100 tensions the chain 80 between the active idler 99 and the sprocket 57. A conventional chain front active idler 76 tensions the chain 80 between the sprocket 57 and the sprocket 110. The movement of the active idlers 99 and 76 is driven by movement of the various links coordinated with the movement of other componets of the steering unit 50, to keep tension on the chain 80 despite movement of the sprockets around which chain 80 passes, during shifting between steering modes.

As shown in Fig. 11B, a differential middle sprocket chain 81 extends around the first center sprocket 144 of the rear transmission 104, around a middle differential sprocket chain rear active idler 75, and around the middle differential sprocket 111. A middle differential sprocket chain front active idler 77 tensions the chain 81 between sprockets 111 and 144. The active idlers 75 and 77 similarly maintain tension on the chain 81.

As shown in Fig. 11C, a right rear chain 83 extends around the lower sprocket 149 of the rear transmission 104 and around the lower right rear sprocket 59 on the axle 53. The chain 83 is tensioned by fixed idlers 78 and 79.

As shown in Figs. 9 and 12, a right round chain 82 extends around the lower sprocket 146 on the rear transmission 104, and around fixed idlers 96 and 98. The back or reverses side of the right round chain 82 engages the center sprocket 122 on the rear transmission distributor.--

UNITED STATES PATENT AND TRADEMARK OFFICE

CERTIFICATE OF CORRECTION

PATENT NO. : 6,135,463
DATED : October 24, 2000
INVENTOR(S) : Micheal C. Wrike

It is certified that error appears in the above-identified patent and that said Letters Patent is hereby corrected as shown below:

Column 11,
Line 35 correct "t6" to read --to--.

Claim 4, Column 12,
Line 33 please correct "sidewalls" to read --sidewall--.
Line 47 please correct "forward" to read --longitudinal--.

Claims 6-9, columns 12, 13, 14,
Please DELETE.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*